US008757136B2

(12) United States Patent
Rieser et al.

(10) Patent No.: US 8,757,136 B2
(45) Date of Patent: Jun. 24, 2014

(54) GAS HOB

(75) Inventors: Frank Rieser, Groebenzell (DE); Heiko Thielen, Munich (DE); Gerd Wilsdorf, Olching (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1156 days.

(21) Appl. No.: 10/575,036

(22) PCT Filed: Oct. 8, 2004

(86) PCT No.: PCT/EP2004/011272

§ 371 (c)(1),
(2), (4) Date: Apr. 7, 2006

(87) PCT Pub. No.: WO2005/036059

PCT Pub. Date: Apr. 21, 2005

(65) Prior Publication Data

US 2007/0074714 A1 Apr. 5, 2007

(30) Foreign Application Priority Data

Oct. 9, 2003 (DE) ..... 103 46 962

(51) Int. Cl.
*F23D 14/06* (2006.01)
*F24C 3/08* (2006.01)
*F24C 3/12* (2006.01)

(52) U.S. Cl.
USPC ..... 126/39 R; 126/40

(58) Field of Classification Search
USPC ..... 126/39 R, 214 C, 167, 215, 50, 39 BA, 126/211, 212; D7/346
See application file for complete search history.

(56) References Cited

U.S. PATENT DOCUMENTS

| | | | | | |
|---|---|---|---|---|---|
| 4,003,360 | A | * | 1/1977 | Branson | 126/39 E |
| 4,971,024 | A | * | 11/1990 | Albon et al. | 126/39 B |
| 5,000,157 | A | * | 3/1991 | Harper et al. | 126/41 R |
| 5,002,039 | A | * | 3/1991 | Esposito | 126/214 C |
| D421,694 | S | * | 3/2000 | Kitabayashi et al. | D7/346 |
| D458,803 | S | * | 6/2002 | Becker et al. | D7/408 |
| D470,359 | S | * | 2/2003 | Jones et al. | D7/408 |
| D481,589 | S | * | 11/2003 | Becker et al. | D7/408 |

FOREIGN PATENT DOCUMENTS

| | | |
|---|---|---|
| DE | 199 07 193 | 8/2000 |
| DE | 102 37 288 | 6/2003 |
| EP | 0 532 251 | 3/1993 |
| EP | 1 344 982 | 9/2003 |
| GB | 2 149 497 | 6/1985 |
| GB | 2 297 612 | 8/1996 |

OTHER PUBLICATIONS

International Search Report PCT/EP2004/011272.

* cited by examiner

*Primary Examiner* — Thomas Denion
*Assistant Examiner* — Daniel Bernstein
(74) *Attorney, Agent, or Firm* — James E. Howard; Andre Pallapies

(57) ABSTRACT

A gas hob includes at least one gas burner, at least one pan support which is used to place a food container over a gas burner, and at least one operational control and/or display element which is arranged on the gas hob. The pan support includes at least one setback section that defines an operational area wherein the operational control and/or the display element is arranged in order to ensure that the operational control and/or the display element do not take up too much room.

5 Claims, 3 Drawing Sheets

GAS HOB

The invention relates to a gas hob comprising at least one gas burner, at least one pan support which is used to place a food container over the gas burner and at least one operational control and/or display element which is arranged on the gas hob.

FR 2 730 041 discloses a generic gas hob comprising a gas burner and a pan support. A control element is provided on the cover plate of the gas hob and is positioned before the pan support at the front. The arrangement of the control element on the cover plate certainly provides good operating comfort. However, the arrangement of control elements and/or relevant display elements on the cover plate presents problems with regard to the limited space on the cover plate.

The object of the invention is to provide a gas hob where at least one operational control and/or display element is arranged in a space-saving manner on a cover plate of the gas hob.

The object of the invention is solved by a gas hob having the features of claim 1. According to the characterising part of claim 1, the pan support has at least one setback section at the front, which forms an operational area on the cover plate wherein the operational control and/or display element is arranged. As a result, on the one hand the operational control and/or display element is clearly visible on the top of the gas hob. On the other hand, a space-saving arrangement of these elements is possible.

The setback section is advantageously formed in an outer frame of the pan support element. A clear boundary between a cooking area and the operational area is thereby achieved.

The setback frame section is advantageously constructed as a heat-protecting wall. This is provided between the operational area and the gas burner and protects an operator from heat when actuating the operational control and/or display elements.

In order that the thermal stressing of the operational area is as low as possible, the setback section of the pan support can be constructed substantially centrally between two gas burners.

The setback section of the pan support preferably projects at least partly over the operational control and/or display element. As a result, a food container placed near the operational area can rest on the setback section without coming in contact with the operational control and/or display element.

The operational control and/or display elements in the operational area can advantageously be arranged over a minimum distance of 3 to 10 cm from the setback section of the pan support. This makes it possible for the operator to actuate the elements without coming in contact with the pan support.

Three exemplary embodiments of the invention are explained hereinafter with reference to the appended figures. In the figures.

Figure 1:
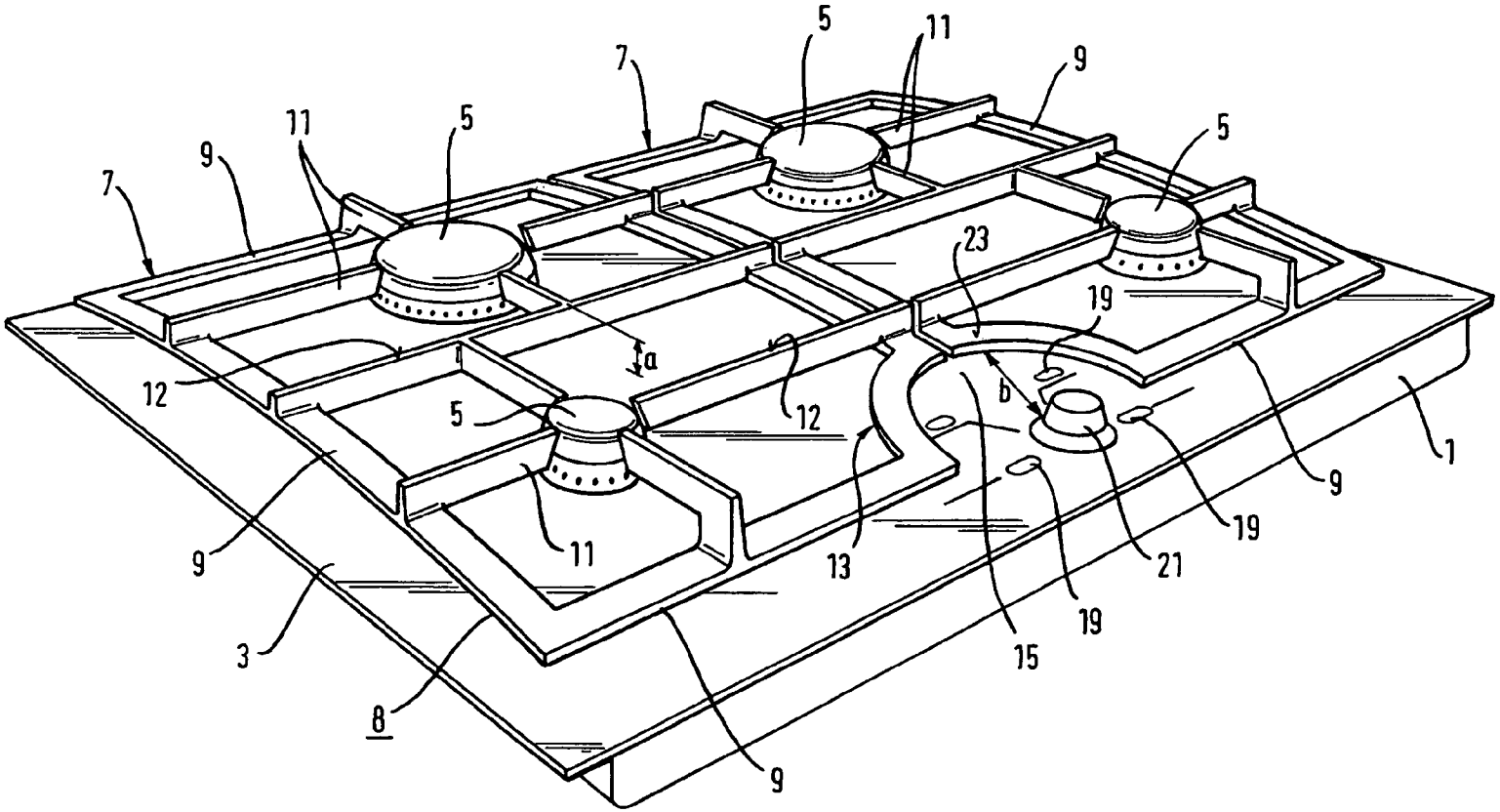
FIG. 1 is a gas hob according to the first exemplary embodiment in perspective view.

FIG. 1 shows a gas hob with a trough-shaped recessed housing 1. The open top side of the recessed housing 1 is covered by a glass ceramic plate 3. Mounting openings through which the gas burners 5 project are constructed in the glass ceramic plate 3. Each of the gas burners 5 forms a gas cooking point. Two adjacent pan supports 7 made of cast iron are located in the glass ceramic plate 3. Associated with each of the pan supports 7 are two gas burners 5. Each of the pan supports has an outer frame 8 with frame strips 9 arranged at right angles to one another. The pan supports 7 are also constructed with pan support ribs 11. These ribs either join the opposing frame strips 9 or project with their free ends in the direction of the gas burners 5. The pan support ribs form a placement surface 12 for food containers. The placement surface 12 runs in one plane located at a distance a above the glass ceramic plate 3. As a result, food containers placed thereon can easily be displaced between the gas burners 5.

According to FIG. 1, the two pan supports 7 each have at their adjacent front corner areas a setback frame section 13 which is substantially circular-arc-shaped and extends over an angle of rotation of 90°. The two setback frame sections 13 define an operational area 15 on the glass ceramic plate 3 which is open at the front. In FIG. 1 the operational area 15 is arranged substantially centrally between the two front gas burners 5. A magnetically retained rotary knob 21 is disposed in the operational area 15 concentrically to the setback frame sections 13. The rotary knob 21 is located at a distance b of about 8 cm from the setback frame section 13. Furthermore, the rotary knob 21 is surrounded by four display symbols 19 which are allocated to the gas burners 5.

The rotary knob 21 can be used to centrally control all the gas burners 5. For operation of one of the gas burners 5 the magnetically retained rotary knob 21 is first pushed towards the display symbol 19 which is allocated to the selected gas burner 5. As a result, the selected gas burner 5 is activated. The rotary knob 21 is then pushed back into its initial position. The heating power of the selected gas burner 5 can be adjusted by a subsequent rotary actuation of the rotary knob 21. The heating power is displayed by the display symbol 19 allocated to the selected gas burner 5.

Figure 2:
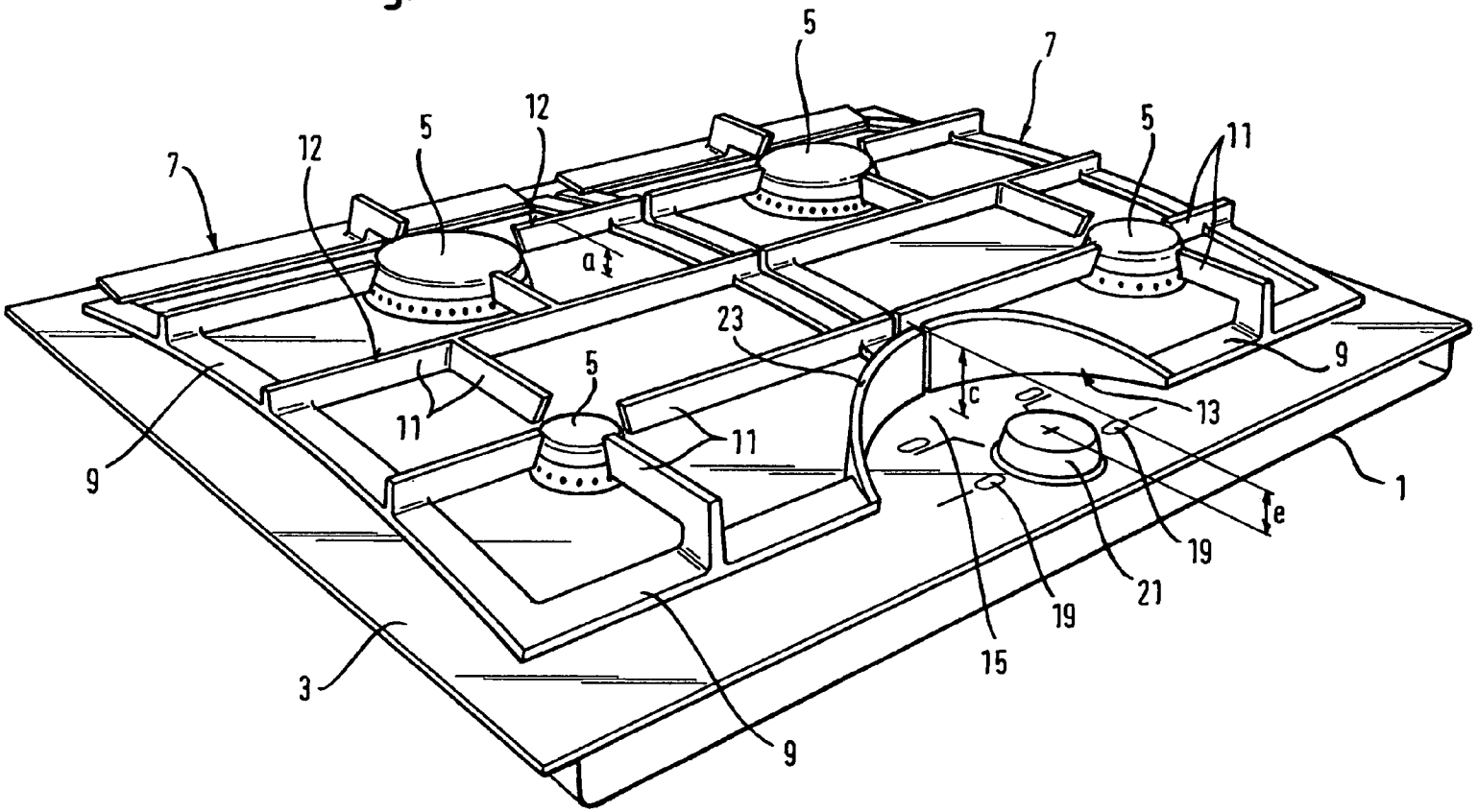
FIG. 2 is a gas hob according to the second exemplary embodiment in perspective view.

The exemplary embodiment shown in FIG. 2 substantially corresponds to the first exemplary embodiment. As shown in FIG. 1, according to this figure circular-arc-shaped frame sections 13 are also constructed at the adjacent front corner areas of the pan support 7. The setback frame sections 13 of the pan support 7 define the operational area 15. Unlike FIG. 1, the setback frame sections 13 of the pan support 7 are constructed as vertically elevated heat-protecting walls. These heat-protecting walls ascend in a ramp fashion starting from the flat front frame strips 9 up to a maximum height c. As can be seen clearly from FIG. 2, the heat-protecting walls 13 terminate almost tightly with the glass ceramic plate 3. Any convection flow of hot air in the direction of the operational area 15 is thereby reliably avoided.

In the area of their maximum height c the heat-protecting walls 13 on the one hand project above the rotary knob 21 up to a distance e. On the other hand, the upper sides 23 of the heat-protecting walls always run below the placement surface 12 for food containers provided by the pan support ribs 11. Thus, food containers can be displaced on the pan support ribs 11 without impacting against the heat-protecting walls.

Figure 3:
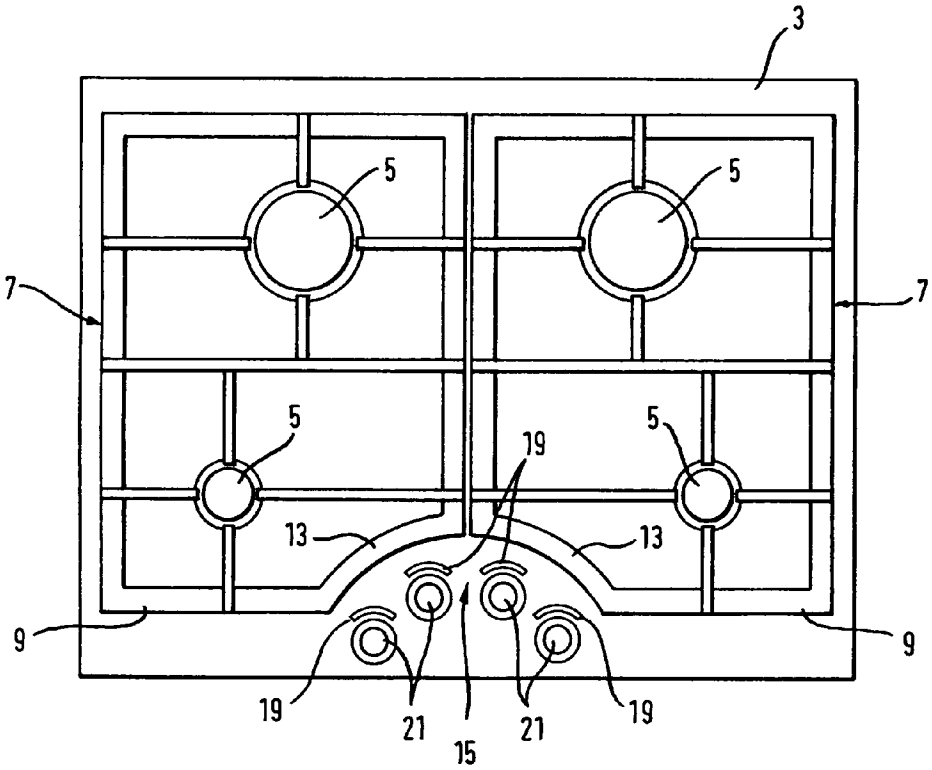
FIG. 3 is a gas hob according to the third exemplary embodiment viewed from above.

Instead of the central rotary knob 21 for all four gas burners 15, according to the exemplary embodiment from FIG. 3, each gas burner 5 has a rotary knob 21. According to FIG. 3, the rotary knobs 21 are arranged in a space-saving fashion in the operational area 15 following the circular-arc profile of the frame sections 13. The resulting trapezoidal arrangement of the four rotary knobs 21 makes it possible to uniquely allocate the rotary knobs 21 to the respective gas burners 5.

The invention claimed is:

1. A gas hob comprising:

a housing;

at least two gas burners;

at least one operational control to control the at least one gas burner, the at least one operational control being provided between the two gas burners;

at least one pan support supported by the housing and to support food over the at least one gas burner, the pan support including at least one set back frame section that defines an operational area in which the at least one operational control is positioned, the set back frame section including an upwardly projecting heat protecting wall to separate the at least one operational control from each of the at least two gas burners.

2. The gas hob according to claim 1, wherein the at least one pan support includes at least two separate sections each defining part of the heat protecting wall.

3. The gas hob according to claim 1, wherein the heat protecting wall has a ramped shape that increases in height from the front of the housing to the rear of the housing.

4. The gas hob according to claim 3, wherein the heat protecting wall is arc-shaped.

5. The gas hob according to claim 1, wherein the heat protecting wall has a lower end dimensioned to be placed tightly against a support plate of the housing.

* * * * *